US009698485B2

(12) United States Patent
Gaier

(10) Patent No.: US 9,698,485 B2
(45) Date of Patent: Jul. 4, 2017

(54) MODULE FOR WIRELESS COMMUNICATION AND METHOD FOR PRODUCING A MODULE FOR WIRELESS COMMUNICATION

(71) Applicant: Robert Bosch GmbH, Stuttgart (DE)

(72) Inventor: Stefan Gaier, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/646,597

(22) PCT Filed: Oct. 23, 2013

(86) PCT No.: PCT/EP2013/072150

§ 371 (c)(1),
(2) Date: May 21, 2015

(87) PCT Pub. No.: WO2014/082800

PCT Pub. Date: Jun. 5, 2014

(65) Prior Publication Data

US 2015/0295319 A1 Oct. 15, 2015

(30) Foreign Application Priority Data

Nov. 30, 2012 (DE) ..... 10 2012 221 940

(51) Int. Cl.

| | |
|---|---|
| ***H01Q 9/26*** | (2006.01) |
| ***H01Q 9/06*** | (2006.01) |
| ***H01Q 1/38*** | (2006.01) |

(52) U.S. Cl.

CPC ..... *H01Q 9/065* (2013.01); *H01Q 1/38* (2013.01); *H01Q 9/26* (2013.01)

(58) Field of Classification Search

CPC ..... H01Q 9/065; H01Q 1/38; H01Q 9/26

(Continued)

(56) References Cited

U.S. PATENT DOCUMENTS 5,821,902 A * 10/1998 Keen ..... H01Q 1/243 343/700 MS
7,750,864 B2 * 7/2010 Hilgers ..... G06K 19/07749 343/700 MS (Continued)

FOREIGN PATENT DOCUMENTS

CN 101142750 A 3/2008
CN 101796688 A 8/2010

(Continued)

OTHER PUBLICATIONS

International Search Report for PCT/EP2013/072150, dated May 2, 2014.

*Primary Examiner* — Brian Young
(74) *Attorney, Agent, or Firm* — Norton Rose Fulbright US LLP; Gerard Messina

(57) ABSTRACT

A module for wireless communication includes: a module body which (i) is plate-shaped, has (ii) a structure having a plurality of layers, and (iii) has a circuit region; and a folded dipole which is situated circumferentially around the circuit region and has a first dipole half situated in a first level of the module body, and a second dipole half situated in a second level of the module body. The first dipole half and the second dipole half are separated by a layer of the module body, and are connected to one another in electrically conductive fashion through a first via and a second via extending through the layer.

9 Claims, 4 Drawing Sheets

(58) Field of Classification Search
USPC ..... 343/893, 793, 803
See application file for complete search history.

(56) References Cited

U.S. PATENT DOCUMENTS

| | | | | |
|---|---|---|---|---|
| 8,446,331 | B2 * | 5/2013 | Johnson | H01Q 1/38<br>343/803 |
| 2004/0090372 | A1 | 5/2004 | Nallo et al. | |
| 2010/0289712 | A1 | 11/2010 | Zheng et al. | |
| 2011/0205126 | A1 | 8/2011 | Ishimiya et al. | |
| 2013/0201074 | A1 | 8/2013 | Harper et al. | |

FOREIGN PATENT DOCUMENTS

| | | | |
|---|---|---|---|
| CN | 102394350 | A | 3/2012 |
| DE | 10 2008 007 239 | | 4/2009 |
| EP | 1 206 000 | | 5/2002 |
| EP | 1 786 663 | | 5/2007 |
| JP | H09-247006 | A | 9/1997 |
| JP | H11-205181 | A | 7/1999 |
| JP | 2002-152353 | A | 5/2002 |
| JP | 2006-109183 | A | 4/2006 |
| JP | 2007-142799 | A | 6/2007 |
| JP | 2007-336331 | A | 12/2007 |
| JP | 2010-161495 | A | 7/2010 |
| JP | 2012-049864 | A | 3/2012 |
| WO | WO 2004/040697 | | 5/2004 |

* cited by examiner

MODULE FOR WIRELESS COMMUNICATION AND METHOD FOR PRODUCING A MODULE FOR WIRELESS COMMUNICATION

BACKGROUND OF THE INVENTION

1 . Field of the Invention

The present invention relates to a module for wireless communication, and to a method for producing a module for wireless communication.

2 . Description of the Related Art

For wireless communication, antennas are used, for example in the form of dipole antennas. Such antennas can be integrated into a circuit module. Published German patent application document DE 10 2008 007 239 A1 describes a module and a method for producing a module.

BRIEF SUMMARY OF THE INVENTION

Against this background, the present invention presents a module for wireless communication, and a method for producing a module for wireless communication.

An antenna is designed for a specified frequency range. When designing the antenna, an effective length of the antenna is an important shaping criterion. In order to make it possible to house the antenna in a small flat module, the antenna can be configured, in folded form, in adjacent levels of the module. Here, the antenna can be configured so as to surround a circuit region. In order to utilize the space in optimal fashion, the antenna can, if needed, almost completely enclose the circuit region. The antenna can be configured in two levels of the module situated one over the other, in the form of a folded dipole. Advantageously, in this way the module can have small dimensions. If the circuit region is surrounded almost completely, the antenna can have a radiation characteristic that is nearly uniform in all directions.

A module for wireless communication is presented, the module having the following features:

a plate-shaped module body, having a circuit region, the module body having at least one layer by which a first level and a second level of the module body are separated from one another; and a folded dipole that is situated circumferentially around the circuit region on the module body, the folded dipole having a first dipole half that is situated in the first plane of the module body, and having a second dipole half that is situated in the second plane of the module body, the first dipole half and the second dipole half being connected to one another in electrically conductive fashion by a first via and a second via through the at least one layer of the module body.

Wireless communication can be understood as a transmission of electric magnetic waves and, alternatively or in addition, a receiving of electromagnetic waves. A folded dipole can take the form of an antenna that has a conductor loop having a specified length. The conductor loop can be divided into two dipole halves connected to one another in electrically conductive fashion, and oriented parallel to one another with a small spacing from one another. Electrical terminals of the folded dipole can be situated in the center of a dipole half of the folded dipole. Apart from a connection region, the two dipole halves can be made congruent to one another. Each of the dipole halves can have an axial symmetry. If the module body has a plurality of levels, then a level can be formed between each two adjacent levels, and on each of the outer surfaces of the outer levels a level can be formed on which a dipole half can be situated. An electrical circuit of the module can be situated in a circuit region of the module. The circuit region can be oriented centrically relative to the module. Through a via, one or more levels can be electrically connected to one another through one or more layers. The module can be rectangular or can have some other suitable shape, for example a round shape. A shape of the dipole halves can be matched to a shape of the module bearer.

The first dipole half can have, within the first level of the module body, and the second dipole half can have, within the second level of the module body, in each case an angled or curved routing. For example, the dipole halves can each have at least two or at least four bending points, for example right-angled ones, situated in their level. In this way, the dipole halves can be laid around the circuit region.

The at least one layer can have a circuit board. The first dipole half and the second dipole half can be situated on opposite surfaces of the circuit board. A circuit board can be made up of one or more layers of circuit board material. In particular, the circuit board can be made up of glass fiber textile and epoxy resin, in particular having the material designation FR4 (flame retardant). The folded dipole can be situated on two opposite sides of the circuit board. In this way, a good radiation characteristic can be achieved.

The at least one layer can include a protective layer. The first dipole half and the second dipole half can be situated on opposite surfaces of the protective layer. A protective layer can for example be an insulating layer that can be applied after functional elements of the circuit have been situated on the module. In this way, for example circuit elements of a circuit of the module can be protected.

The protective layer can for example be realized by a casting compound. Such a protective layer can easily be applied using currently standard production methods.

The module body can have a further protective layer that is situated between the circuit board and the already-named protective layer. In this way, the folded dipole can be integrated into a composite made up of at least two protective layers.

The module body can have a shielding cap for the electromagnetic shielding of the circuit region. At least one of the dipole halves can be configured circumferentially at a distance from the shielding cap.

In this way, it can be avoided that a radiation characteristic of the folded dipole is undesirably influenced by the shielding cap.

At least one of the dipole halves can be made of the same material as the shielding cap. The at least one dipole half of the folded dipole can be situated in the same level as the shielding cap, and can be produced in the same working step as the shielding cap. For example, the shielding cap can be printed onto the module simultaneously with the dipole half.

In addition, a method is presented for producing a module for wireless communication, the method having the following steps:

provision of a layer of a module body made up of a plurality of levels;

integration of a first dipole half on a first side of the layer, the first dipole half being configured circumferentially around a circuit region, and integration of a second dipole half on a second side of to the layer, the second dipole half being configured congruent to the first dipole half, circumferentially around the circuit region; and contacting of the first dipole half to the second dipole half through a first via and a second via through the layer, in order to produce a folded dipole for wireless communication.

In the following, the present invention is explained in more detail on the basis of the accompanying drawings.

DETAILED DESCRIPTION OF THE INVENTION

Figure 1:
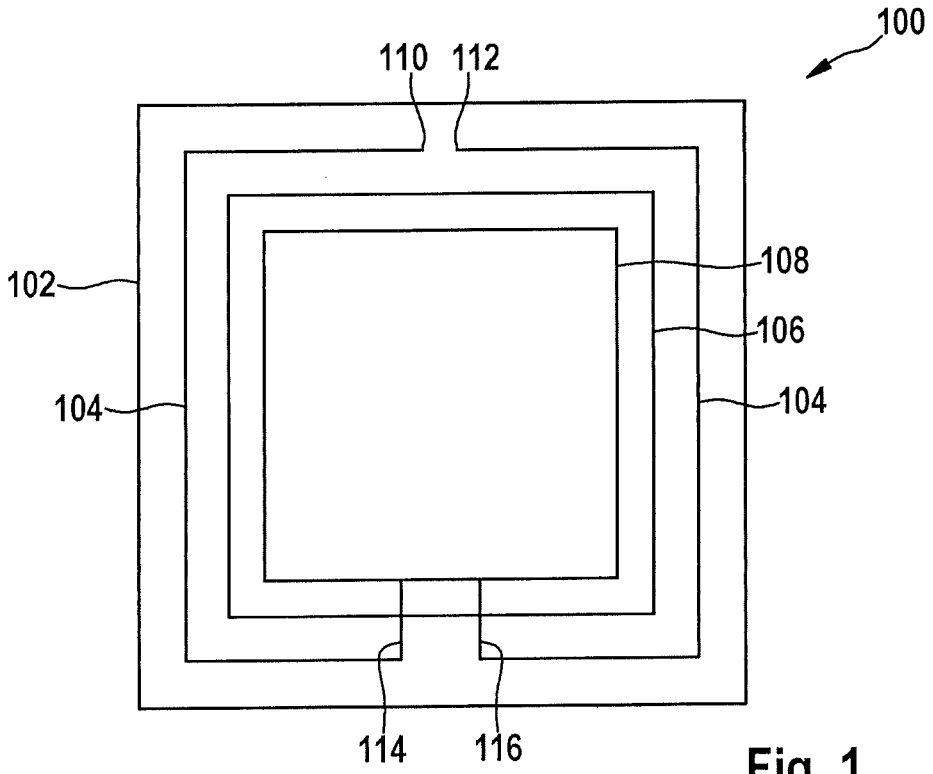
FIG. 1 shows a schematic representation of a module for wireless communication according to an exemplary embodiment of the present invention.

In the following description of preferred exemplary embodiments of the present invention, identical or similar reference characters are used for elements shown in the various Figures and having similar functions, and a repeated description of such elements is not provided.

FIG. 1 shows a schematic representation of a module 100 for wireless communication according to an exemplary embodiment of the present invention. Module 100 has a module body 102 having a folded dipole 104. Module body 102 is made in the shape of a plate. Module body 102 has at least one layer by which at least two levels of module body 102 are separated from one another. The levels can for example be situated on opposite surfaces of the at least one layer. In module body 102 there is situated a circuit region 106 for the accommodation of an electrical circuit 108, for example an integrated circuit.

The at least one layer of module body 102 can for example be a circuit board layer or a protective layer.

Folded dipole 104 has a first dipole half and a second dipole half. First dipole half 302 is situated in a first level of module body 102. The second dipole half is situated in a second plane of the module body. Here, the second dipole half is situated on the underside or on an intermediate level of module body 102, and is therefore not visible in FIG. 1. Folded dipole 104 is situated circumferentially around circuit region 106. The first dipole half and the second dipole half are separated by at least one layer of module body 102, and are connected to one another in electrically conductive fashion through a first via 110 and a second via 112.

In the top view, the first dipole half runs in a continuous rectangular fashion, except for regions laid between vias 110, 112 and terminals 114, 116. In particular, the first dipole half has four right-angled bending points through which the first dipole half can be routed along an outer edge of circuit region 106.

Folded dipole 104 is connected to circuit region 106 via electrical terminals 114, 116. In this way, folded dipole 104 can be used by circuit 108 situated within circuit region 106, for example in order to wirelessly transmit a transmit signal via folded dipole 104, or to receive a received signal via folded dipole 104.

Module 100 can be a standard circuit board module having integrated vertical folded dipole 104. In this case, the at least one layer of the module can be a circuit board or a layer of a circuit board. Folded dipole 104 can be used as a standard antenna. Folded dipole 104 can be printed or integrated on module body 102, for example a circuit board, in order to realize folded dipole 104 in the form of an antenna at low cost. In this way, folded dipole 104 can also be vertically integrated in module body 102 by printing.

Folded dipole 104 can be used for a radio interface of a module 100 in the form of a circuit module. Such a radio to interface, e.g. Bluetooth, Wi-Fi, etc., requires an antenna for radiation. Such an antenna can be realized in the form of folding dipole 104 on standard circuit board material, for example epoxy resin and glass fiber fabric. Folding dipole 104 shown here has the highest radiation quality, and also occupies as little space as possible.

Figure 2:
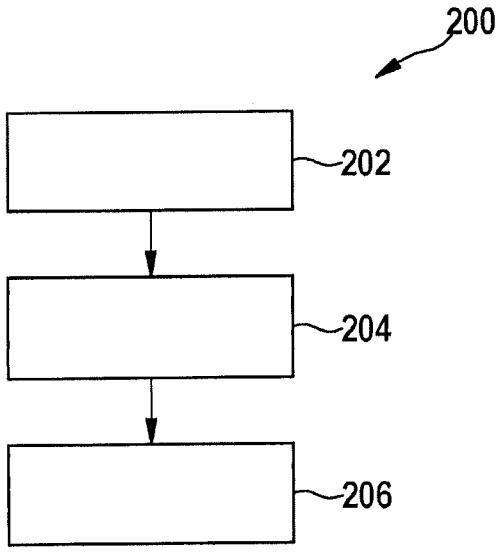
FIG. 2 shows a schematic diagram of a method for producing a module for wireless communication according to an exemplary embodiment of the present invention.

FIG. 2 shows a schematic diagram of a method 200 for producing a module for wireless communication according to an exemplary embodiment of the present invention. This can be a module as shown in FIG. 1. Method 200 has a step 202 of provision in which a layer, made up of a plurality of levels, of a module body is provided. In a step 204 of integration, a first dipole half is integrated on a first side of the layer. The first dipole half is here configured circumferentially around a circuit region of the module body. A second dipole half is integrated on a second side of the layer. The second dipole half is configured circumferentially around the circuit region, congruent to the first dipole half. In a step 206, the first dipole half is electrically contacted to the second dipole half through the layer, through a first via and a second via, in order to form a folded dipole for wireless communication. Here the folded dipole corresponds for example to the folded dipole shown in FIG. 1.

To produce the module for wireless communication, according to an exemplary embodiment only standard circuit board processes are used, so that, using the approach presented here, low-cost modules can be produced in high piece counts. The folded dipole can also be realized on circuit boards having other shapes, e.g. round or polygonal, and can have a corresponding shape.

Figure 3:
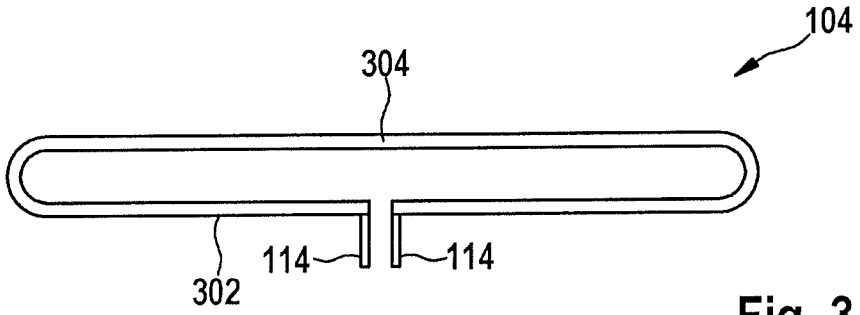
FIG. 3 shows a representation of a folded dipole.

FIG. 3 shows an example of a representation of a folded dipole 104. Folded dipole 104 is fashioned as a folded conductor loop. Folded dipole 104 has a first dipole half 302 and a second dipole half 304. First dipole half 302 and second dipole half 304 have the same effective length. Second dipole half 304 is oriented parallel to first dipole half 302, with a small spacing therefrom. In the center of first dipole half 302, folded dipole 104 has electrical terminals 114, 116. The conductor loop is interrupted at electrical terminals 114, 116. FIG. 3 shows a standard dipole 104. Differing from this, dipole halves 302, 304, shown having straight lines, can be varied in their shape, in order for example to be routed around a circuit region, as described on the basis of FIG. 1.

Through a curved or angled shape of dipole halves 302, 304, the length of folded dipole 104 can be reduced in comparison with the representation of a straight folded dipole 104 shown in FIG. 3. For example, an angled folded dipole 104 can have, at the frequencies standardly used (e.g. 2.45 GHz), a spatial extension that does not exceed standard sizes of, for example, circuit modules. Folded dipole 104 can have a radiation characteristic that for example enables radiation to all sides. This is an advantage in comparison with antennas in the form of SMD components, which usually do not radiate uniformly to all sides due to reasons of placement.

Figure 4:
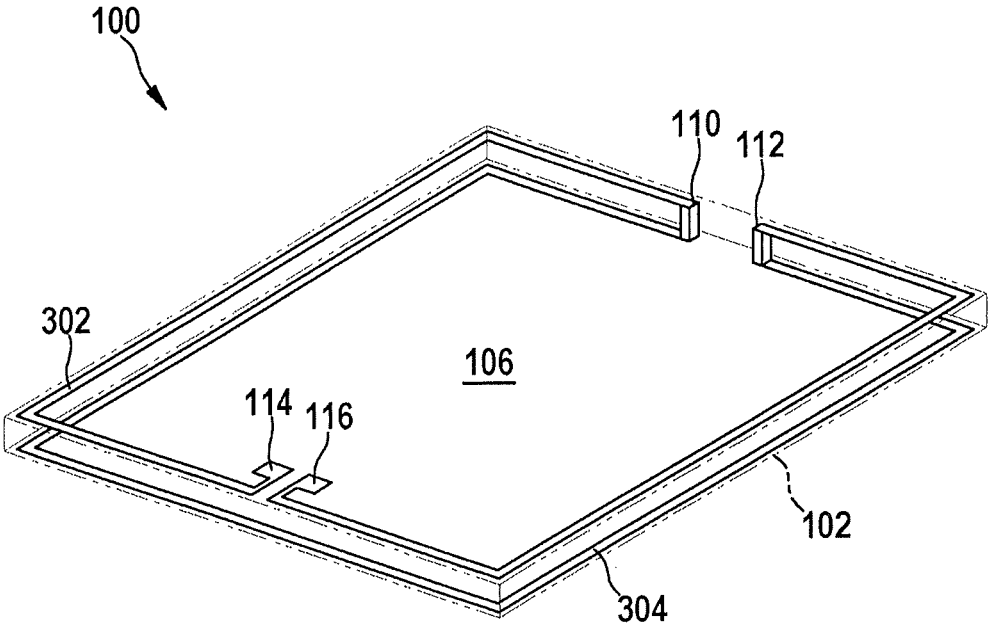
FIG. 4 shows a spatial representation of a module for wireless communication according to an exemplary embodiment of the present invention.

FIG. 4 shows a spatial representation of a module 100 for wireless communication according to an exemplary embodiment of the present invention. Module 100 corresponds to the module as shown in FIG. 1. Module body 102 is shown in transparent fashion in order to illustrate the three-dimensional position of the folded dipole. Module body 102 is here fashioned as a rectangular circuit board. In order not to hide folded dipole 104, the circuit region around which the folded dipole is routed is not shown.

The folded dipole has a first dipole half 302 and a second dipole half 304, connected to one another in electrically conductive fashion through vias 110, 112 through module body 102. First dipole half 302 is shown on an upper side of module body 102. Situated opposite vias 110, 112, the folded dipole has, on first dipole half 302, two electrical terminals 114, 116, which can for example be realized as contacting surfaces. Going out from terminal 114, an electrical conductor forming the folded dipole extends on an upper side of module bearer 102, and extends along the edge of module bearer 102 to via 110, and extends from via 110 on a lower side, opposite the upper side, of module bearer 102, and extends along the edge of module bearer 102 to further via 112. From further via 112, the electrical conductor extends on the upper side of module bearer 102 and extends along the edge of module bearer 102 to further terminal 116. First dipole half 302 is thus made up of two segments that are symmetrical to one another that are routed along opposite edge surfaces of module bearer 102. Second dipole half 304 extends along the entire edge of module bearer 102, except for the edge segment laid between vias 110, 112. Corresponding to the rectangular shape of module bearer 102, second dipole half 304 has four corners. Apart from the region of electrical terminals 114, 116, the routing and the shape of first dipole half 302 corresponds to that of second dipole half 304. The electrical conductor of the dipole can be routed directly on the edge of module bearer 102, or can be routed at a distance from the edge of module bearer 102. Thus, the folded dipole almost completely surrounds a cuboidal region of module bearer 102.

Module 100 shown in FIG. 4 is made up of the vertical integrated folded dipole that is laid around a circuit not shown in FIG. 4. The circuit can be situated in the named circuit region, and connected to electrical terminals 114, 116.

Shown is a possible realization of the folded dipole in the form of an antenna, as a realization of the vertical folded dipole on the edge of module bearer 102, here in the form of a circuit board. Here, the folded dipole has vias 110, 112 in the form of vias routed through module bearer 102, electrical terminals 114, 116 in the form of antenna terminals on a circuit board upper side of module bearer 102, and second dipole half 304 on the circuit board underside of module bearer 102.

In detail, module 100 is made up of a vertical folded dipole that is situated on two layers of a module bearer 102 in the form of a circuit board. Here, the folded dipole can for example be situated on the uppermost and on the lowermost layer, and it is also possible to use interior layers of module bearer 102. The dipole ends of the folded dipole are connected through vias 110, 112 in module bearer 102. The folded dipole is externally routed around the actual electronic circuit, and therefore requires very little space, and radiates outwardly, away from module 100, in a uniform fashion, as shown in FIG. 5.

In the center of folded dipole 104, the circuit, with its conductors and components, can be housed on the upper side and lower side of module bearer 102.

Figure 5:
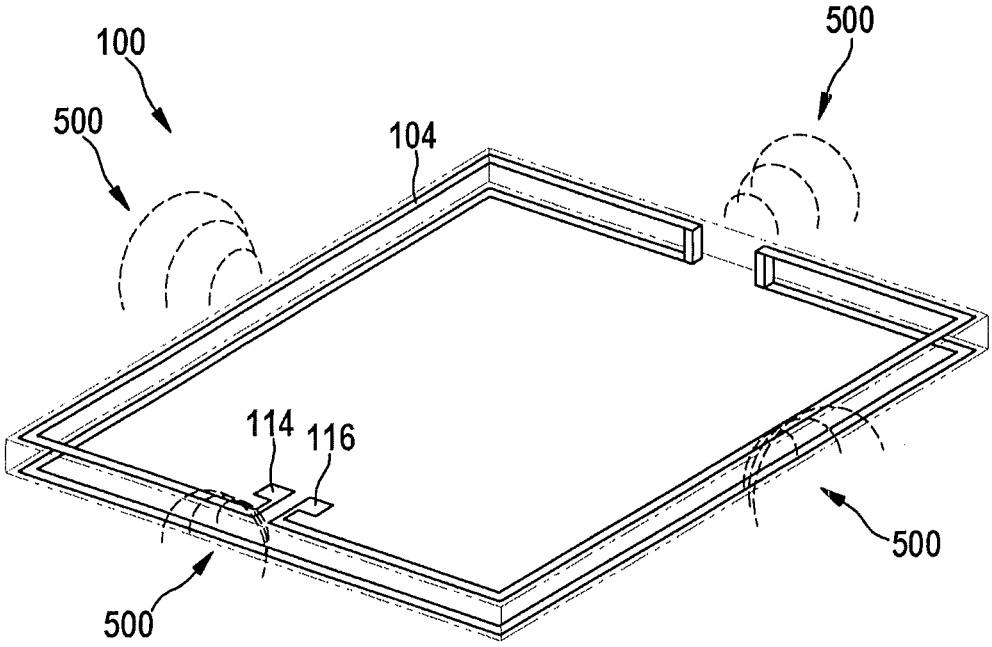
FIG. 5 shows a spatial representation of a radiation characteristic of a module for wireless communication according to an exemplary embodiment of the present invention.

FIG. 5 shows a spatial representation of a radiation characteristic 500 of a module 100 for wireless communication according to an exemplary embodiment of the present invention. Module 100 corresponds to the module shown in FIG. 4. Shown is radiation 500 of a vertical folded dipole 104.

When an electrical signal is applied to antenna terminals 114, 116, folded dipole 104 emits electromagnetic waves. Because folded dipole 104 is situated circumferentially around the entire module 100, folded dipole 104 radiates equally in all directions.

Figure 6:
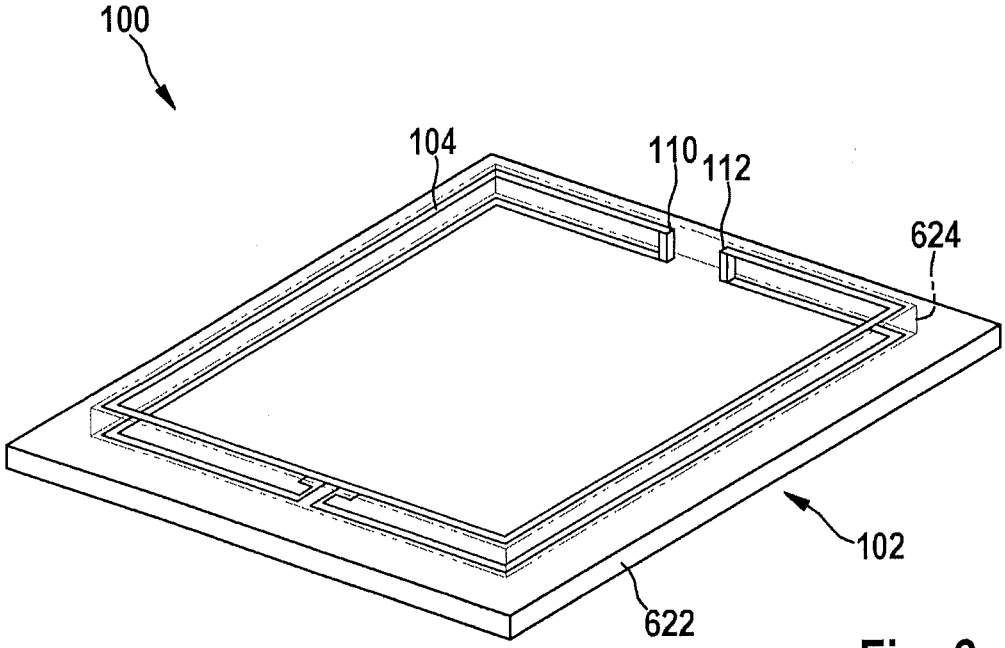
FIG. 6 shows a spatial representation of a module for wireless communication having a protective layer according to an exemplary embodiment of the present invention.

FIG. 6 shows a spatial representation of a module 100 for wireless communication according to an exemplary embodiment of the present invention. According to this exemplary embodiment, module body 102 has a circuit board 622 and a protective layer 624 that covers at least a part of a surface of circuit board 622. Circuit board 622 has a circuit region. Protective layer 624 can for example cover the circuit region in order to protect a circuit situated in the circuit region. Module 100 has a folded dipole 104 as described for example on the basis of FIG. 4. Protective layer 624 is shown in transparent fashion. The first dipole half of folded dipole 104 is situated on a surface of circuit board 622 facing protective layer 624. The second dipole half of the folded dipole is situated on an outer side of protective layer 624, facing away from circuit board 622. Vias 110, 112 of folded dipole 104 pass through protective layer 624. Here, protective layer 600 is an epoxy resin.

FIG. 6 shows, according to an exemplary embodiment, a vertical folded dipole 104 in which the lower dipole half is realized on the circuit board upper side and the upper dipole half is realized on a protective layer 624, the so-called mold. In the depicted module 100, in the form of a circuit board module, for example a circuit board side of circuit board 622 is cast together with the components situated thereon with a molding compound, protective layer 624, preferably based on epoxy resin. The mold compound can be metallized for shielding reasons, and this metallization can be structured. The lower part of folded dipole 104 is structured on the upper side of circuit board 622, but the upper part of folded dipole 104 is structured on the molding compound of protective layer 624. The two connecting vias 110, 112 between the dipole halves can be connected through trough-mold vias (TMVs). These are bored through the molding compound, downward to the upper side of the circuit board, e.g. using a laser, and are metallized.

Figure 7:
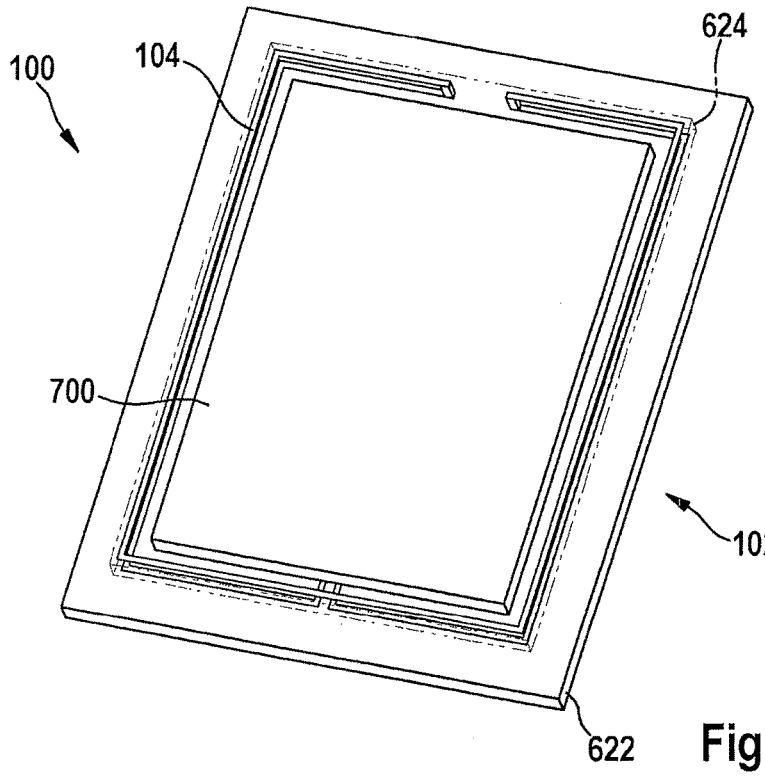
FIG. 7 shows a spatial representation of a module for wireless communication having a shielding cap according to an exemplary embodiment of the present invention.

FIG. 7 shows a spatial representation of a module 100 for wireless communication having a shielding cap 700 according to an exemplary embodiment of the present invention. Module 100 corresponds to the module shown in FIG. 6. In addition, shielding cap 700, made of electrically conductive material, is situated over the circuit region of molded-in circuit board 622. Shielding cap 700 and the second dipole half of folded dipole 104 can here be produced from the same material. Shielding cap 700 and the second dipole half can be applied onto protective layer 624 in the same working step.

According to an exemplary embodiment, in the center of module 100 there is situated shielding cap 700, which shields the active part of the electronic circuit. Under this cap 700 there can also be situated the RF component that is connected to antenna 104. This shielding cap 700 is formed by the structured metallization on the mold upper side and vias (TMVs) on the upper side of the circuit board. In other words, FIG. 7 shows a vertical folded dipole 104 in which a shielding cap 700 is situated in the center.

Figure 8:
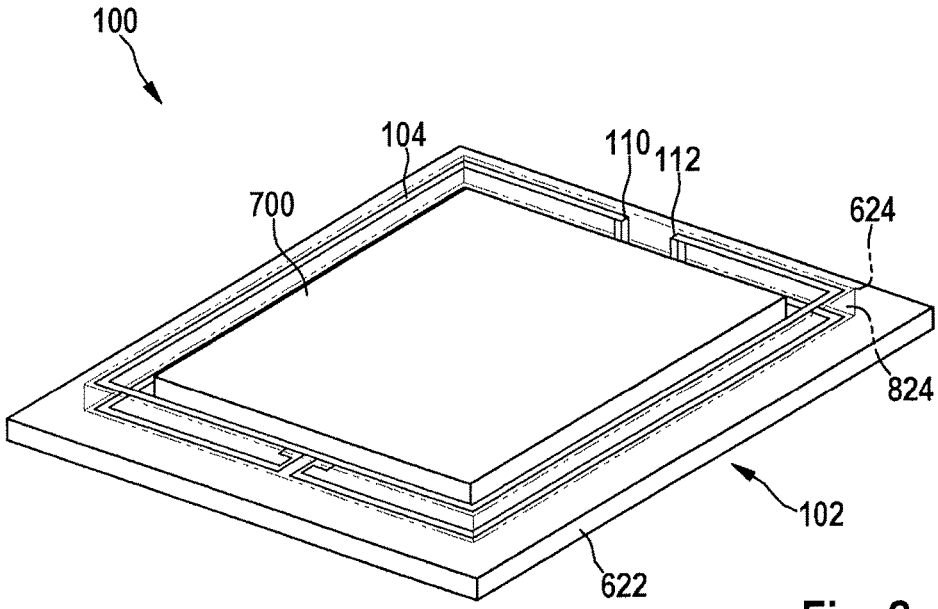
FIG. 8 shows a spatial representation of a module for wireless communication having a folded dipole on the protective layer according to an exemplary embodiment of the present invention.

FIG. 8 shows a spatial representation of a module 100 for wireless communication having a folded dipole 104 according to an exemplary embodiment of the present invention. Module 100 corresponds to the module in FIG. 7, but has a further protective layer 824 between circuit board 622 and protective layer 624. One dipole half of folded dipole 104 is situated on an outer surface of protective layer 624. The other dipole half of folded dipole 104 is situated on a level between protective layer 524 and further protective layer 824, for example on the surface facing away from circuit board 622 of further protective layer 824. Protective layer 624 is penetrated by vias 110, 112 of folded dipole 104.

In the case of a multi-layer mold compound, as shown for example in FIG. 8 by protective layers 624, 824, folded dipole 104 can also be situated completely on two molded layers. In other words, FIG. 8 shows a vertical folded dipole 104 in which both dipole halves are situated on molded layers.

The exemplary embodiments described and shown in the Figures have been selected only as examples. Different exemplary embodiments can be combined with one another in their entirety or with regard to individual features. One exemplary embodiment can also be supplemented with features of another exemplary embodiment. In addition, method steps according to the present invention may be repeated, and may be executed in a sequence differing from that described.

What is claimed is:

1. A module for wireless communication, comprising:

a plate-shaped module body having a circuit region, wherein the module body includes at least one layer by which a first level and a second level of the module body are separated from each other; and a folded dipole antenna situated circumferentially around the circuit region on the module body, wherein the folded dipole antenna has (i) a first dipole antenna half situated in the first level of the module body, and (ii) a second dipole antenna half situated in the second level of the module body, the first dipole antenna half and the second dipole antenna half being connected to one another in electrically conductive fashion through a first via and a second via extending through the at least one layer of the module body.

2. The module as recited in claim 1, wherein the first dipole antenna half within the first level and the second dipole antenna half within the second level of the module body each have an angled or curved routing.

3. The module as recited in claim 1, wherein the at least one layer has a circuit board, and the first dipole antenna half and the second dipole antenna half are situated on surfaces of the circuit board situated opposite one another.

4. A module for wireless communication, comprising:

a plate-shaped module body having a circuit region, wherein the module body includes at least one layer by which a first level and a second level of the module body are separated from each other; and a folded dipole situated circumferentially around the circuit region on the module body, wherein the folded dipole has (i) a first dipole half situated in the first level of the module body, and (ii) a second dipole half situated in the second level of the module body, the first dipole half and the second dipole half being connected to one another in electrically conductive fashion through a first via and a second via extending through the at least one layer of the module body, wherein the at least one layer has a protective layer, and the first dipole half and the second dipole half are situated on surfaces of the protective layer situated opposite one another.

5. The module as recited in claim 4, wherein the protective layer is a casting compound.

6. The module as recited in claim 4, wherein the module body has a further protective layer situated between the circuit board and the protective layer.

7. A module for wireless communication, comprising:

a plate-shaped module body having a circuit region, wherein the module body includes at least one layer by which a first level and a second level of the module body are separated from each other; and a folded dipole situated circumferentially around the circuit region on the module body, wherein the folded dipole has (i) a first dipole half situated in the first level of the module body, and (ii) a second dipole half situated in the second level of the module body, the first dipole half and the second dipole half being connected to one another in electrically conductive fashion through a first via and a second via extending through the at least one layer of the module body, wherein the module body has a shielding cap for electromagnetic shielding of the circuit region, and wherein at least one of the dipole halves is situated circumferentially and at a distance from the shielding cap.

8. The module as recited in claim 7, wherein at least one of the dipole halves is produced from the same material as the shielding cap.

9. A method for producing a module for wireless communication, comprising:

providing a layer of a module body made up of a plurality of levels;

integrating a first dipole antenna half on a first side of the layer, the first dipole antenna half being situated circumferentially around a circuit region, and integrating a second dipole antenna half on a second side of the layer, the second dipole antenna half being situated congruent to the first dipole half, circumferentially around the circuit region; and contacting the first dipole antenna half with the second dipole antenna half through a first via and a second via extending through the layer in order to produce a folded dipole antenna for wireless communication.

* * * * *